United States Patent [19]

DeFever

[11] 4,156,316

[45] May 29, 1979

[54] SKI BOOT ATTACHMENT

[76] Inventor: Michael D. DeFever, 5511 W. Parkview, Mequon, Wis. 53092

[21] Appl. No.: 772,526

[22] Filed: Feb. 28, 1977

[51] Int. Cl.[2] ..... A43B 5/00; A43B 3/10

[52] U.S. Cl. ..... 36/132; 36/7.5

[58] Field of Search ..... 36/132, 135, 136, 7.5, 36/7.6, 7.8

[56] References Cited

U.S. PATENT DOCUMENTS

| | | | |
|---|---|---|---|
| 2,214,052 | 9/1940 | Good | 36/132 |
| 2,810,213 | 10/1957 | Jonas | 36/7.5 |
| 3,866,339 | 2/1975 | Latto | 36/7.6 |
| 3,971,144 | 7/1976 | Stuker | 36/117 |

FOREIGN PATENT DOCUMENTS

| | | | |
|---|---|---|---|
| 2363131 | 6/1975 | Fed. Rep. of Germany | 36/132 |

*Primary Examiner*—Patrick D. Lawson

*Attorney, Agent, or Firm*—Basile and Weintraub

[57] ABSTRACT

A device for facilitating walking while wearing a ski boot includes a main body portion which shifts the center of gravity of the ski boot and which is fitted to the sole of the ski boot. The device includes means for attaching the device to the heel and toe portions of the ski boot associated therewith. When fitted to a ski boot a walking type of movement is effectuated, which enables the user to wear ski boots, without discomfort, for extended periods of time while walking with the ski boot.

4 Claims, 4 Drawing Figures

SKI BOOT ATTACHMENT

BACKGROUND OF THE INVENTION

1. Field of the Invention

The present invention pertains to the art of skiing. More particularly, the present invention pertains to the art of ski boots. Even more particularly, the present invention pertains to attachments for ski boots which facilitate the walking thereon.

2. Prior Art

As is known to those skilled in the art to which the invention pertains, it is extremely difficult and cumbersome to walk while wearing ski boots. This is especially so when walking is attempted for extended periods of time. This is attributable to the fact that the ski boot is, in and of itself, heavy and cumbersome. Furthermore, its purpose is to facilitate skiing and not walking. Thus, it applies pressure to areas of the leg, including the ankles and the calves which are not ordinarily encountered with shoes. Thus, ordinarily, after finishing skiing for any extended period of time, one ordinarily observes a skier removing the boot and replacing them with after ski boots. If the skier then desires to return to the ski slopes, this requires a further change from the after ski boot to the ski boot. This is a readily observed fact whether the skier returns to the ski slopes quickly or waits extended periods.

It is to be appreciated from the preceding that a major contribution to the art would be provided if there were to be devised an attachment for the ski boot which would facilitate walking while elevating the discomfitures associated with the ski boot while attempting to walk therewith. The present invention, as will subsequently be detailed, provides such a device.

Heretofore, the prior art has disclosed devices which contemplate facilitating walking. See, inter alia, It will be appreciated from a review of the prior art that such devices are not readily adaptable to ski boots. Furthermore, it will be appreciated that such devices cannot readily be attached and detached from a ski boot or other type of footwear. Again, the present invention overcomes such problems.

SUMMARY OF THE INVENTION

In accordance with the present invention, there is provided an attachment for footwear, and in particular, a ski boot, which is adapted to facilitate walking therewith. The walking stride which is effectuated by the attachment of the present device is a "rocking" motion. Such a motion is intended to compensate for the forward positioning of the legs when wearing footwear such as ski boots and wherein extreme pressure is applied to the calves and lower portions of the leg which distends the leg from the perpendicular, which is the normal position for walking.

The device or attachment hereof comprises an enlarged central portion having a length and width substantially equal to the length and width of the sole or bottom surface of a footwear item, such as a ski boot. The upper surface of the central or main body portion is a generally flat surface. The bottom or lower surface of the central portion has an arcuate or concave configuration.

The present invention further comprises means disposed at both the front and rear portions thereof for detachably mounting the device to the footwear item.

In a preferred embodiment the means disposed at the rear or heel portion of the device comprises a latching member which fits onto the peripheral rim of the sole of the footwear item. The front or toe mounting means comprises a locking member which is particularly adapted to fit into a notch formed in the toe area of the sole of the footwear item.

The present invention can be formed from any suitable material and is lightweight in nature thereby rendering its deployment quite easy even for the novice. For a more complete understanding of the present invention, reference is made to the following detailed description and accompanying drawing.

In the drawing like reference characters refer to like parts throughout the several view in which:

DESCRIPTION OF THE PREFERRED EMBODIMENT

Figure 1:
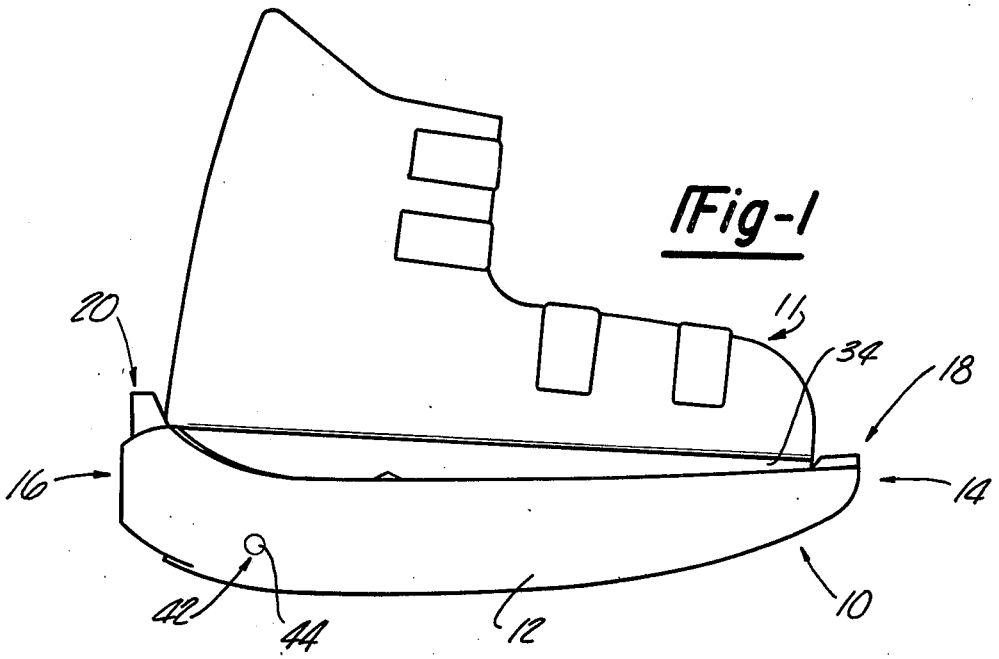
FIG. 1 is a side elevational view of a ski boot having the device of the present invention secured thereonto.

Now, and with reference to the drawing, there is depicted therein a device, generally denoted at 10, for facilitating walking. The device 10 is intended to be secured to an article of footwear such as a ski boot 11.

The device 10 hereof comprises a central body portion 12, a first or toe end 14 and a rear or heel end 16. The central body portion and the respective ends being integrally formed to provide a unitary device. The device 10 further comprises means, generally denoted at 18, for attaching the device 10 to the toe portion of the article of the footwear 11. The device 10 further comprises means, generally denoted at 20 for attaching the device 10 to the heel portion of the article of footwear 11.

With more particularity, the central or main body portion 12 comprises an enlarged portion having a substantially flat planar upper surface 22 and an arcuate or convex lower surface 24. The arcuate lower surface 24 converges towards the upper planar surface 22 at both ends thereof. The area of convergence at the forward end defines the toe section 14 and the area of convergence at the rearward end defines the heel portion 16 of the device hereof.

The substantially flat planar upper surface 22 is dictated solely by the article of footwear with which the present invention is associated. Specifically, and as is known to those skilled in the art to which the invention pertains, a ski boot generally has a flat or planar sole. Thus, to achieve secure attachment, the upper surface of the present invention is, also, flat to provide contiguous surfaces between the instant device and the footwear item.

With respect to the arcuate lower surface, and as will subsequently be detailed, this facilitates the achievement of the "rocking" motion attendant the deployment and usage of the present device.

Figure 2:
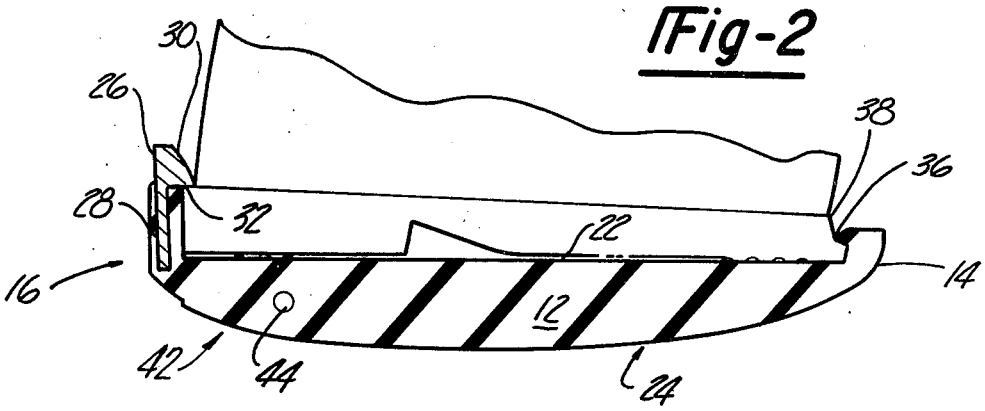
FIG. 2 is a cross-sectional view depicting the attachment of the present device, FIG. 2 being similar to FIG. 1 but being in cross-section.
Figure 3:
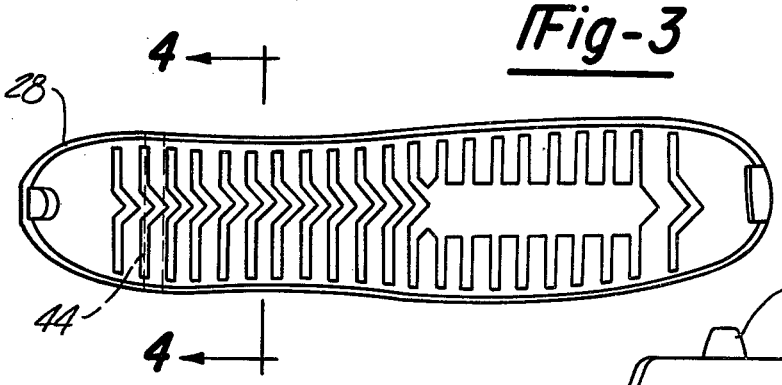
FIG. 3 is a top plan view of the device of the present invention.
Figure 4:
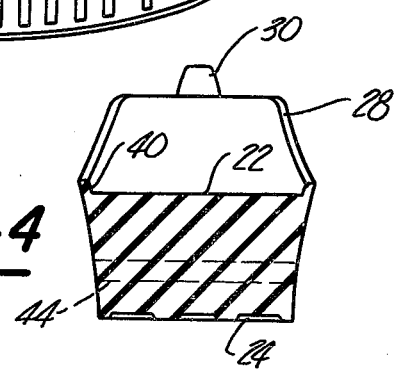
FIG. 4 is an end elevational view, partly in cross-section, of the device of the present invention.

Referring again to the drawing, and as heretofore noted, the rearward portion of the present device comprises means 16 for securing the present invention to the heel of the footwear item. The means 16 generally comprises a locking member 26 which projects above the planar surface 22. The locking member 26 comprises an upstanding leg 28 which is arcuate in nature and which is adapted to define a shield about the heel of the footwear item. Centrally disposed about the arcuate member is the locking member 26, per se. The locking member 26 comprises an inwardly directed surface 30 which terminates at a surface 32, which intrudes into the space above the planar surface 22. The distance between the surface 32 and the surface 22 is equal to the height of the sole 34 of the footwear item 12. In this manner, the member 26 locks onto the sole, as shown in FIG. 2.

The toe locking means 14 generally comprises an inwardly directed latching or locking member 36 which is formed centrally of toe portion of the device 10. The member 36 is adapted to fit and project within a notch 38 formed within the sole 34 of the footwear item.

In forming the device hereof and in order to ensure a snug fit, an upstanding peripheral wall 40 can be formed about the planar surface 22 and integrally with the wall 28.

In order to render the present invention fully efficacious, the present invention contemplates the formation of means, generally denoted at 42, for facilitating the mounting of the present device onto a ski pole or the like. Generally, the means 42 comprises an aperature or opening 44 formed through the member 12 transversed to the longitudinal axis of the device. The opening 44 is dimensioned to be slightly larger than the diameter of a conventional ski pole.

In utilizing the present invention, the device is fitted beneath the ski booth such that the locking member 36 projects into the notch formed in the ski boot and the locking member surface 30 is then slid over the heel portion of the sole of the footwear item. In this manner, the device is securely locked onto the footwear item. Because of the arcuate nature of the bottom portion, a "rocking" walking effect can be readily achieved. In order to detach and remove the present device from the footwear item, the locking member surface 30 is rotated away from the sole such that the surface 32 is disengaged from the sole and the device is rotated such thereafter or otherwise moved such that the locking member 36 is removed from the notch.

It is to be noted with respect hereto that because of the dimensioning hereof that without such disengagement of the locking member 26 that otherwise and ordinarily the device hereof is securely mounted onto the footwear item.

In forming the present device, any suitable lightweight materials can be employed, such as cork, synthetic resinous materials, etc. can be utilized herein.

Also, and in order to promote traction, a grain or sole design can be imparted to both the planar surface 22 as well as the arcuate surface 24.

Having, thus, described the invention, what is claimed is:

1. An integrally formed footwear walking assistance device, comprising:

(a) a main body having a substantially planar upper surface and an arcuate lower ground engaging surface, converging towards the upper planar surface at both ends thereof, a first area of convergence defining a forward portion and a second area of convergence defining a rearward portion;

(b) means for attaching the device to the heel of a footwear item formed at the rearward portion thereof comprising:

(1) an arcuate wall projecting above the planar surface, (2) a locking member disposed atop the arcuare wall, the locking member comprising a sloped wall and an inwardly directed wall parallel to the planar surface converging therewith, the distance between the inwardly directed wall and the planar surface being substantially equal to the height of the heel of the footwear item, the locking member enpaging the top of the heel;

(c) means for attaching the device to the toe of a footwear item formed at the forward portion thereof; and (d) means for mounting the device formed through the main body.

2. The device of claim 1 in combination with a footwear, (a) the toe of the footwear item having a notch formed therein, and (b) the toe attaching means comprises a locking member disposed atop the planar surface, the locking member comprising means projecting into the notch of the footwear item.

3. The device of claim 2 wherein the footwear item is a ski boot.

4. The device of claim 1 wherein:

the main body is provided with an aperture formed therethrough, transverse to the longitudinal axis, defining the mounting means.

* * * * *